United States Patent [19]

Kegelman

[11] 4,423,354

[45] Dec. 27, 1983

[54] METHOD AND APPARATUS FOR CONTROLLING ELECTRODE VOLTAGE IN ELECTRON BEAM TUBES

[75] Inventor: Thomas D. Kegelman, Ridgefield, Conn.

[73] Assignee: KCR Technology, Inc., East Hartford, Conn.

[21] Appl. No.: 219,971

[22] Filed: Dec. 24, 1980

[51] Int. Cl.[3] ..... H01J 29/41

[52] U.S. Cl. ..... 315/12 R; 346/158; 315/374

[58] Field of Search ..... 315/374, 372, 12 R, 315/30; 358/300; 346/158

[56] References Cited

U.S. PATENT DOCUMENTS 3,040,124 6/1962 Camras ..... 315/374

3,663,748 5/1972 Boon ..... 358/300

*Primary Examiner*—Theodore M. Blum

*Attorney, Agent, or Firm*—Hayes & Reinsmith

[57] ABSTRACT

A controlling electrode is positioned in physical proximity to one or more electrodes in an electron beam tube so that the controlling and controlled electrodes are subject to common electron bombardment. A control voltage of preselected magnitude and polarity is applied to the controlling electrode. During the common electron bombardment, primary and secondary electrons are present in the region of the electrodes, an exchange of electrons occurs between the electrodes, and the voltage on the controlled electrodes switches to a value at or near the voltage applied to the controlling electrode. The electron beam tube can be a cathode ray pin tube used in electrostatic printing in which case a single controlling electrode is positioned in proximity to the array of conductive pins in the tube face plate. The voltage applied to the controlling electrode is made more negative than the potential of an unscanned pin and the maximum negative voltage of the pins is controlled to improve the ultimate quality of electrostatic printing provided by the tube. A tube face plate comprises two segments which cooperate to define a V-shaped groove facing the beam, which positions portions of the pins at an angle to the beam, and one of the segments receives the controlling electrode in a manner establishing the spacing of the electrode from the pins.

25 Claims, 15 Drawing Figures

METHOD AND APPARATUS FOR CONTROLLING ELECTRODE VOLTAGE IN ELECTRON BEAM TUBES

BACKGROUND OF THE INVENTION

This invention relates to the art of electronic tube devices of the electron beam type, and more particularly to a new and improved method and apparatus for controlling the voltage on one or more electrodes in these devices such as cathode ray pin tubes.

When it is desired to vary the voltage of an electrode in a vacuum tube this has been done by means of a lead from the electrode through the tube envelope to an external circuit. When many electrodes of the same device must be controlled, this approach requires a lead configuration which is difficult or even impossible owing to the large number of vacuum seals required in the tube envelope and mechanical constraints imposed by the connecting leads. It therefore would be highly desirable to provide control of one or more electrodes of a vacuum tube device in a manner obviating the need to have leads connected to each electrode and extending through the tube envelope.

The foregoing considerations are particularly appropriate for cathode ray pin tubes, also known as conductive face plate cathode ray tubes, which are used to transfer information typically in electrostatic printing. Briefly, such devices include a face plate having an array of closely-spaced conductive pins which extend through the faceplate and which become charged when the electron beam impinges upon the pin and thus can be used to transfer information. In an electrostatic printer a dielectric medium, such as a belt accepts a charge from the pins of the device to form a latent image of the information which thereafter is developed by toner and transferred to paper. It is important to control the voltage on the individual pins of the device because pin voltage anomalies can adversely affect the ultimate printing quality.

SUMMARY OF THE INVENTION

It is, therefore, an object of this invention to provide a new and improved method and apparatus for controlling the voltage on one or more electrodes in an electronic tube device of the electron beam type.

It is a more particular object of this invention to provide such method and apparatus for controlling one or more electrodes of such devices in a manner obviating the need to have leads connected to each electrode and extending through the tube envelope.

It is a further object of this invention to provide such method and apparatus for controlling the voltage on a large number of closely-spaced electrodes in a single device.

It is a further object of this invention to provide such method and apparatus for controlling the voltage on the individual pins of a cathode ray pin tube.

It is a more particular object of this invention to provide such control of the pin voltage in a cathode ray pin tube in a manner which improves the ultimate quality of electrostatic printing provided by the tube.

It is a further object of this invention to provide a new and improved face plate construction for cathode ray pin tubes which enables such pin voltage control to be accomplished in a convenient and effective manner.

The present invention provides a method and apparatus for controlling the voltage on one or more electrodes in an electronic tube device of the electron beam type wherein a controlling electrode is provided in physical proximity to the electrode to be controlled, the controlling electrode being so positioned that the tube electron beam scans the controlled electrode and the controlling electrode simultaneously. A control voltage of predetermined magnitude and polarity is applied to the controlling electrode. During the period of common electron bombardment of the controlled and controlling electrodes, primary and secondary electrons are present in the region of the electrodes and an exchange of electrons takes place between the electrodes. The magnitude and polarity of the voltage applied to the controlling electrode are selected to switch the voltage on the controlled electrode to a desired level, typically at or near the voltage on the controlling electrode. The foregoing is accomplished in a non-contacting manner, and the voltages on a plurality of electrodes advantageously can be controlled by a single common controlling electrode to which the control voltage is applied. The invention can be employed in a cathode ray pin tube wherein a single controlling electrode is positioned in proximity to the array of conductive pins in the face plate of the tube such that each pin and a corresponding portion of the controlling electrode are subjected to common electron bombardment as the pins are scanned successively by the electron beam. The control voltage is selected to be more negative than that of an unscanned pin, with the result that the maximum negative voltage of the pins is controlled to improve the ultimate quality of electrostatic printing provided by the tube. A tube faceplate comprises two segments which cooperate to define a region facing the beam, preferably a V-shaped groove, which positions the pins in a manner exposing a significantly increased target area for the electron beam so that accuracy of positioning of the electron beam becomes less critical. One of the segments is formed to receive the controlling electrode in a manner establishing the appropriate spacing of the electrode from the pins.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
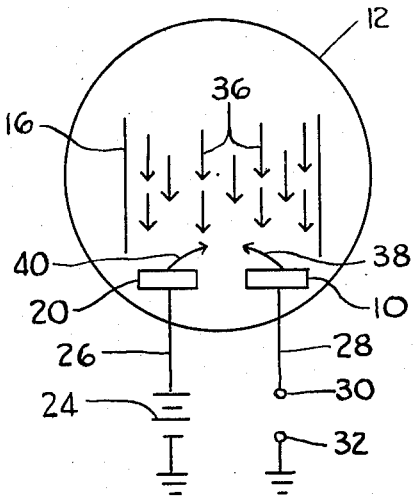
FIG. 1 is a schematic diagram illustrating the principles of the present invention for controlling the voltage on an electrode of an electron beam tube device.

In basic electronic tube devices of the electron beam type, in order to vary the voltage on an electrode therein a connection is made by a lead extending from the electrode through the tube envelope to an external circuit, and when the number of electrodes is large the corresponding large number of vacuum seals required in the tube envelope and mechanical constraints imposed by the leads give rise to a lead configuration which is difficult or even impossible. In accordance with the present invention, a controlling electrode is provided in the electron tube device in physical proximity to the electrode to be controlled and so positioned that the tube electron beam scans the controlled and controlling electrodes simultaneously. The electrodes can be disposed in the same plane or in spaced, substantially parallel planes so long as they are exposed to common electron bombardment by the scanning beam. A source of control voltage of preselected magnitude and polarity is connected to the controlling electrode. During the common electron bombardment, primary and secondary electrons are present in the region of the electrodes, and an exchange of electrons takes place between the controlled and controlling electrodes. As a result, the voltage on the controlled electrode is switched to a level at or near the preselected control voltage applied to the controlling electrode. The foregoing is accomplished in a non-contacting manner, i.e. without any conductors connected to the controlled electrode. The voltage on the controlled electrode can be varied in a positive direction or a negative direction in response to a net loss or a net gain in electrons. When a net loss of electrons from the controlled electrode is desired, the apparatus preferably is operated with beam accelerating potential and with the voltage difference between controlling and controlled electrodes both selected to provide a secondary emission ratio of greater than one in the region of the electrodes, and bias current can be supplied to the electrode to remove electrons.

Advantageously, the voltages on a large number of electrodes in an electron beam tube device can be controlled by a single common controlling electrode to which the control voltage is applied. In this connection, a single controlling electrode is positioned in proximity to the array of conductive pins in the face plate of a cathode ray pin tube such that each pin and a corresponding portion of the controlling electrode are subjected to common electron bombardment as the pins are scanned successively by the electron beam. The control voltage applied to the controlling electrode is set at a desired value which is more negative than the potential of an unscanned pin. As a result, the maximum negative voltage of the pins is controlled to improve the ultimate quality of electrostatic printing provided by the tube. A tube face plate comprises two segments of dielectric material between which the array of pins is located and which segments define therebetween a V-shaped groove facing generally toward the beam. A portion of each pin lies along a surface of the groove such that the pin portions are disposed at an angle to the direction of the scanning electron beam so as to expose a significantly increased target area for the beam with the result that accuracy of positioning of the electron beam becomes less critical. The controlling electrode is located in a recess in the surface of the segment against which the pin portions lie, the thickness of the electrode and depth of the recess establishing the appropriate spacing of the electrode from the pins.

Referring now to FIG. 1, a vacuum tube of the electron beam type has an electrode 10 located within an evacuated envelope or housing 12 for bombardment by an electron beam 16 which is generated and controlled in a known manner. It is desired to control the voltage on electrode 10. In accordance with this invention, a controlling electrode 20 is provided in the tube, i.e. within envelope 12, in proximity to electrode 10 and positioned for common, simultaneous electron bombardment with electrode 10 by beam 16. In the device shown, electrodes 10 and 20 which are in the form of metal plates or strips, are disposed in relatively closely spaced apart relation in substantially the same plane. There is also provided means 24 for applying a control potential or voltage to electrode 20. In the device shown, the voltage applying means 24 is a battery, the negative terminal of which is connected to an electrical ground or reference and the positive terminal of which is connected to controlling electrode 20 by means of a conductor 26 extending through envelope 12. The controlled electrode 10 is connected by suitable means to an external load or circuit. For example, in the device shown, electrode 10 is connected by conductor 28 extending through envelope 12 to a terminal 30, a second terminal 32 is connected to an electrical ground or reference, and the load or circuit (not shown) is connected to terminals 30,32.

In operation, beam 16 is generated and controlled in a known manner and scans electrodes 10 and 20 simultaneously. During such scanning, primary electrons flow in the direction indicated by arrows 36 in FIG. 1 and are incident on the surfaces of electrodes 10,20 generally normally to the electrode surfaces. During such scanning, secondary electrons are emitted or released from the metal electrodes and possibly from other parts of the device such as glass or dielectric seals between conductors 26,28 and envelope 12 or even from the envelope itself. Secondary electron paths from electrodes 10 and 20 for example are designated 38 and 40, respectively, in FIG. 1. Thus, during the common electron bombardment of electrodes 10 and 20 primary and secondary electrons are present within the interior of the device and in the region of the electrodes 10,20. During this common electron bombardment an exchange of electrons takes place between the electrodes 10,20. If one electrode is at a high impedance, i.e. the element to be switched, like electrode 10 in FIG. 1, and the other electrode is at low impedance, i.e. the element providing the control through external connection, like electrode 20 in FIG. 1, then the high impedance element, i.e. electrode 10, will attempt to alter its potential to that of the low impedance element, i.e. electrode 20. In other words, the magnitude and polarity of the voltage applied to controlling electrode 20 is selected to cause the exchange of electrons between electrodes during the period of electron bombardment causing the voltage on controlled electrode 10 to switch to a desired level which will be at or approaching the voltage on controlling electrode 20. Thus, control of the voltage on electrode 10 advantageously is provided in a manner which does not require any control leads or conductors extending through envelope 12 to electrode 10, i.e. in a non-contacting manner. Furthermore, the foregoing method and apparatus of the present invention can be employed for independently controlling many electrodes in a vacuum tube device by utilization of the scanning beam in conjunction with a common electrode that is in physical proximity to a plurality of electrodes to be controlled.

Figure 2:
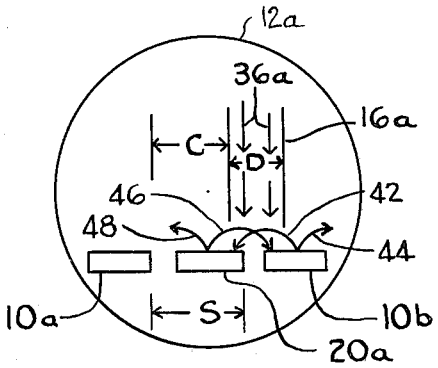
FIG. 2 is a schematic diagram illustrating an alternative arrangement of the apparatus shown in FIG. 1 for controlling the voltage on a plurality of electrodes.

Referring now to FIG. 2 a common controlling electrode **20*a* is shown in close proximity to a plurality of electrodes 10*a*,10*b* to be controlled, the electrodes being within the envelope or housing 12*a* of an electron tube device for bombardment by an electron beam 16*a* which is generated and controlled in a known manner. Electrodes 10*a*,10*b* are connected by conductors (not shown) extending through envelope 12*a* to external loads or circuits in a manner like that of the arrangement of FIG. 1, and a source of control voltage (not shown) is connected to controlling electrode 20*a* by a conductor (not shown) extending through envelope 12*a* in a manner similar to that shown in FIG. 1. The electrodes 10*a*, 20*a*, and 10*b*** are in the form of metal plates on strips, lie in substantially the same plane and are in closely-spaced, edge-to-edge relation.

In operation, scanning beam **16*a* is moved along the arrangement of electrodes to scan first the electrode 10*b* and controlling electrode 20*a* as shown in FIG. 2 and then the electrode 10*a* and controlling electrode 20*a*. Primary electrons flow in the direction of arrows 36*a* in a manner similar to that of FIG. 1. Secondary electrons emitted from electrode 10*b* travel along paths 42,44 and secondary electrons emitted from controlling electrode 20*a* travel along paths 46,48. During the period of common electron bombardment primary and secondary electrons are present in the region of the scanned electrodes, an exchange of electrons takes place between the controlled and controlling electrodes, and the voltage on the controlled electrode switches to a level at or approaching the voltage on the controlling electrode. Thus during the scanning illustrated in FIG. 2, the voltage on controlled electrode 10*b* will switch to a level at or near the voltage on controlling electrode 20*a***.

Both positive and negative voltage transitions are possible since a net increase in electrons causes the high impedance element or electrode to transition negatively, whereas a net loss in electrons will cause the high impedance element to transition positively. The free electron in the scanned region of electrodes **10*b* and 20*a* shown in FIG. 2 will select a velocity vector or direction that is a function of the initial electron velocity and the field gradient present. In the arrangement of FIG. 2, if electrode 10*b* is more positive than electrode 20*a*, a net flow of electrons will be collected on electrode 10*b*, causing it to become more negative. This collection will continue until electrode 10*b* is at the same potential as electrode 20*a*. On the other hand, if electrode 10*b* is more negative than electrode 20*a*, a net electron flow will occur into electrode 20*a* until electrode 10*b* is at the same potential as electrode 20*a***.

During the scanning of electrodes **10*b* and 20*a* illustrated in FIG. 2, some secondary electrons will tend to flow from electrode 20*a* to electrode 10*a* if electrode 10*a* is more positive than electrode 20*a*. Accordingly, to minimize this flow the distance between the scanned beam area of electrodes 10*b* and 20*a* should be made small with respect to the distance to electrode 10*a*. In other words, the beam width D shown in FIG. 2 should be less than the distance designated C. This is equivalent to saying that the beam width D should be small with respect to the distance S which is the width of electrode 20*a* plus edge-to-edge distance between electrodes 20*a* and 10*a***.

Figure 3:
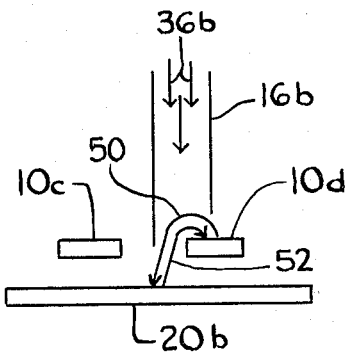
FIGS. 3 and 4 are schematic diagrams illustrating various alternative arrangements of controlled and controlling electrodes in the apparatus of the present invention.
Figure 4:
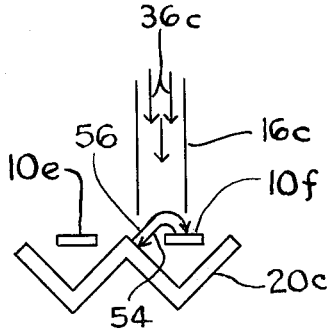

FIGS. 3 and 4 illustrate alternative arrangements of the controlled and controlling electrodes according to the present invention. In FIG. 3 the controlled electrodes **10*c* and 10*d* are in spaced-apart relation in one plane, and the controlling electrode 20*b* is disposed in another plane spaced from and substantially parallel to the plane of electrodes 10*c*,10*d*. In this arrangement, controlling electrode 20*b* is in the form of a continuous strip common to controlled electrodes 10*c*,10*d* and located downstream of controlled electrodes 10*c*,10*d* in terms of the direction of flow of electrons in beam 16*b*. Controlled electrode 10*d* and controlling electrode 20*b* are shown scanned by beam 16*b* in FIG. 3. Secondary electrons emitted from controlled electrode 10*d* flow along path 50 to controlling electrode 20*b*, and secondary electrons emitted from controlling electrode 20*b* flow along path 52 to controlled electrode 10*d***.

In FIG. 4 controlled electrodes **10*e*,10*f* are positioned like the controlled electrodes 10*c*,10*d* of FIG. 3. The controlling electrode 20*c* is of a sawtooth or corrugated shape and is located downstream of controlled electrodes 10*c*,10*d* like electrode 20*b* in the arrangement of FIG. 3. The controlled electrodes 10*c*,10*d* are aligned with and received in adjacent pockets or recesses of the common controlling electrode. Secondary electrons emitted by controlled electrode 10*f* and by controlling electrode 20*c* flow along paths 54 and 56, respectively. Both configurations shown in FIGS. 3 and 4 alter the lateral dispersion of the secondary electron paths as compared to the arrangements of FIGS. 1 and 2**.

Figure 5:
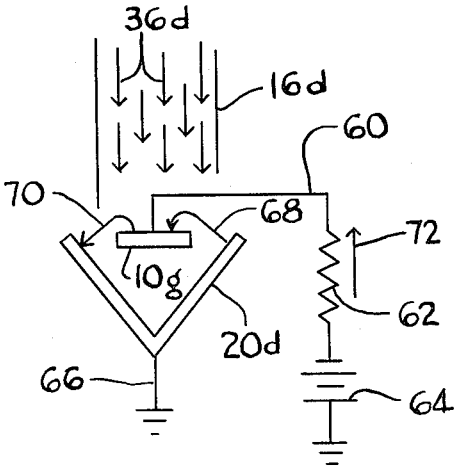
FIG. 5 is a schematic diagram further illustrating the method and apparatus of the present invention.

Additional considerations are illustrated by the arrangement of FIG. 5 wherein a controlled electrode **10*g* is in proximity to a controlling electrode 20*d* of generally V-shaped configuration, similar to one segment of electrode 20*c* shown in FIG. 4. The electrodes are scanned by an electron beam 16*d* in a manner similar to the preceding arrangements, and primary electrons flow along paths designated 36*d*. Controlled electrode is connected by a conductor 60 to one terminal of a resistor 62, the other terminal of which is connected to the negative terminal of a battery 64. The positive terminal of battery 64 is connected to an electrical reference or ground. Similarly, controlling electrode is connected by a conductor 66 to an electrical reference or ground. Conductors 60 and 66 extend through an envelope or housing (not shown) of the electron beam tube. Secondary electrons emitted from controlling electrode 20***d* flow along paths such as that designated 68, and secondary electrons emitted from controlled electrode 10*g* flow along paths such as that designated 70.

Thus, the controlled electrode 10*g* is more negative than the controlled electrode 20*d*, and if electrode 10*g* is to reach the potential of electrode 20*d*, there must be a net loss of electrons from electrode 10*g*. For a net loss to occur, the required direction of flow of current through resistor 62 to controlled electrode 10*g* is indicated by the arrow 72. This direction of current flow requires that the secondary emission ratio in the region of the electrodes be greater than one, i.e. the number of secondary electrons divided by the number of primary electrons must be greater than one. If the secondary emission ratio is less than one, then the controlled electrode 10*g* cannot draw electrons from an external impedance, since the net electron current, i.e. the number of primary electrons minus the number of secondary electrons, is positive in the region of the electrodes. This is true even if all of the secondary electrons were to be collected by controlling electrode 20*d*.

In the arrangement illustrated in FIG. 5, some of the secondary electrons emitted from the controlling electrode 20*d* leave at velocities of over 100 electron volts. If these secondary electrons are further accelerated by an attractive potential of about 100 volts positive to the controlled electrode 10*g*, some net loss of electrons from the controlled electrode 10*g* is possible due to the higher secondary emission ratio known to exist at lower electron energies, i.e. in the range of 200 to 2000 electron volts. The attractive potential to controlled electrode 10*g* is determined by the selected voltage difference between controlling electrode 20*d* and controlled electrode 10*g* by means of voltage source 64. The foregoing is illustrated in further detail by FIG. 6 which is a graph showing the general relationship between primary and secondary electrons for metals. The value shown in FIG. 6 are typical but vary widely for various metals.

Figure 6:
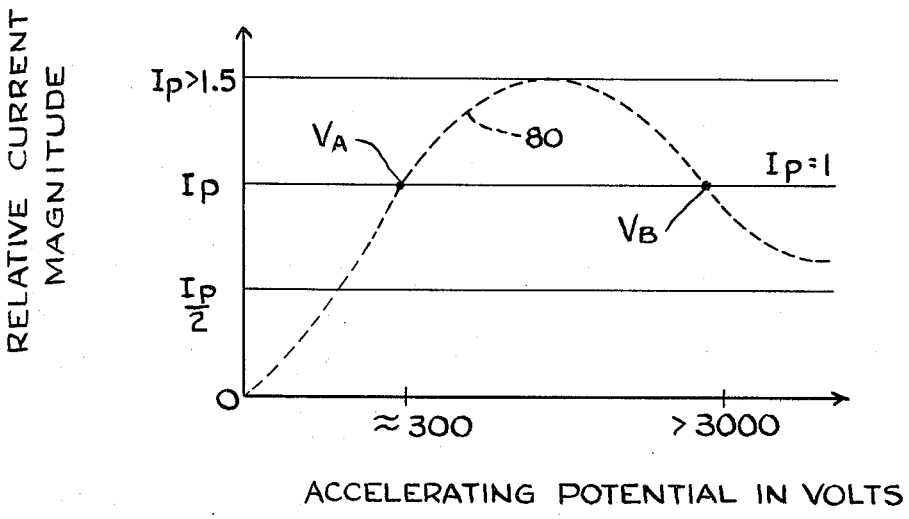
FIG. 6 is a graph showing the general relationship between primary and secondary electrons for metals.

In particular, curve 80 in FIG. 6 is a plot of current due to secondary electron flow as a function of accelerating potential, with the relationship to primary electron current also being shown. The horizontal lines in FIG. 6 represent relative values of primary electron current as compared to secondary electron current. Thus, as the accelerating potential is increased from zero to about 300 volts positive, the secondary electron current represented by curve 80 increases toward the point where the secondary electron current equals the primary electron current. This point of equality, at approximately 300 volts accelerating potential, is designated $V_A$ in FIG. 6 and called the first crossover potential. A further increase in accelerating potential causes the secondary electron current to first increase with increasing accelerating potential and then decrease to a point where it returns to equality with the primary electron current ($I_p=1$). This point designated $V_B$ in FIG. 6 is called the second crossover potential and corresponds to about 3000 volts positive accelerating potential. In the region between the first and second crossovers, the secondary emission ratio is greater than one, i.e. the secondary electron current is greater than the primary electron current. In the region beyond the second crossover, the secondary electron current decreases further.

Figure 7:
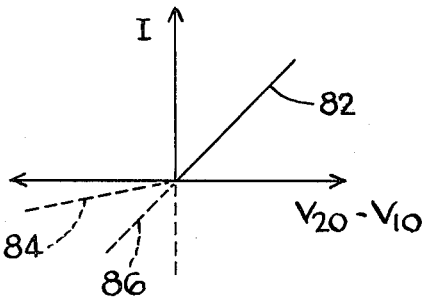
FIG. 7 is a graph showing the relationship between current and the voltage difference between controlled and controlling electrode in the apparatus according to the present invention.

From the relationship illustrated in FIG. 6 the relationship between the net electron current and the voltage difference between controlling and controlled electrodes in the apparatus of this invention may be anticipated. This is illustrated in FIG. 7 which is a plot of net current I as a function of the voltage difference between controlling and controlled electrodes, designated $V_{20}-V_{10}$. The solid portion 82 of the curve in the positive current range represents a net gain of electrons. The two broken line portions 84,86 of the curve in the negative current range represent a net loss of electrons. Portion 84 indicates a near zero current when operating beyond the second crossover point $V_B$ in FIG. 6. Portion 86 represents the current when operating between the first and second crossover points $V_A$ and $V_B$.

Figure 8:
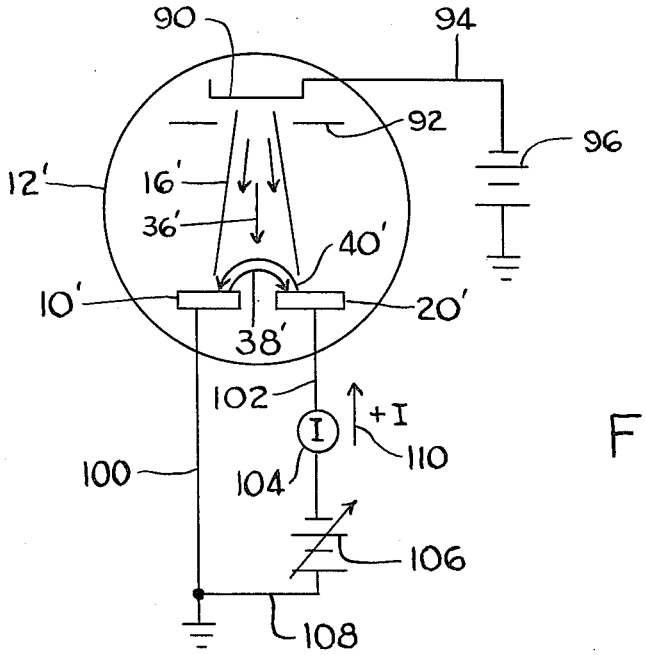
FIG. 8 is a schematic diagram of a variation in the apparatus of FIG. 1.

Accordingly, operation on the negative portion of the curve to provide a net loss of electrons from the controlled electrode is enhanced by operating the apparatus at accelerating potentials between those corresponding to the first and second crossover points, by optimizing the ratios of electrode collection areas and relative potentials between the electrodes to promote secondary emission in the region where the electrode relative potential is between the voltages corresponding to the first and second crossover points, and supplying bias current to the electrodes to remove electrons. In addition, these measures result in a bilateral switching operation of the apparatus. The foregoing is illustrated in FIG. 8 wherein the controlled and controlling electrodes are designated 10' and 20', respectively, and are within an envelope or housing 12' of a vacuum tube electronic device. The electron beam 16' includes primary electrons traveling in the direction of arrows 36', secondary electrons emitted from controlled electrode 10' traveling along path 38', and secondary electrons emitted from controlling electrode 20' traveling along path 40'. The electron beam 16' is produced by a beam forming electrode 90 operatively associated with an element 92 for controlling the beam width in a known manner. Electrode 90 is connected by lead 94 to the negative terminal of a source of beam accelerating voltage 96, the positive terminal of which is connected to an electrical reference or ground. Controlled electrode 10' is connected by conductor 100 to an electrical reference or ground. Controlling electrode 20' is connected by conductor 102 to one terminal of a current source 104, the other terminal of which is connected to the negative terminal of a variable voltage source 106. The positive terminal of source 106 is connected by conductor 108 to an electrical reference or ground. Source 96 determines the accelerating potential which preferably is at a value between $V_A$ and $V_B$ as previously described. Source 106 determines the voltage difference between electrodes 20' and 10', i.e. $V_{20'}-V_{10'}$, which preferably is set between $V_A$ and $V_B$. Source 104 supplies bias current to controlling electrode 20', the direction of current flow being indicated by arrow 110 in FIG. 8.

The method and apparatus of the present invention thus provides control of the voltage on one or more electrodes in an electronic tube device of the electron beam type advantageously in a manner which does not require connection of any control leads or conductors to the electrode or electrodes of the device and extending through the device envelope or housing. According to the present invention, the voltage on one or more of the electrodes is controlled simply and effectively by a single controlling electrode to which an externally variable or selectable control voltage is applied. Advantageously, a single controlling electrode can be provided common to a number of electrodes in a device for controlling the voltage on those electrodes.

A highly desirable use of the method and apparatus of the present invention is in controlling the voltage on the individual pins of a cathode ray pin tube. Cathode ray pin tubes or conductive face plate cathode ray tubes are well known in the art and generally are devices which, instead of having the usual phosphor-coated face plate to display information by luminescence, have a face plate containing a large number of actual conductive pins extending through the face plate. These pins become charged when the electron beam generated in the tube impinges on each pin and thus can be used to transfer information. A typical use for such tubes is in an electrostatic printer wherein a dielectric medium such as a belt accepts charge from the pins of the tube to form a latent image of the information of the belt which thereafter is developed by toner for transfer such as to paper.

Figure 9:
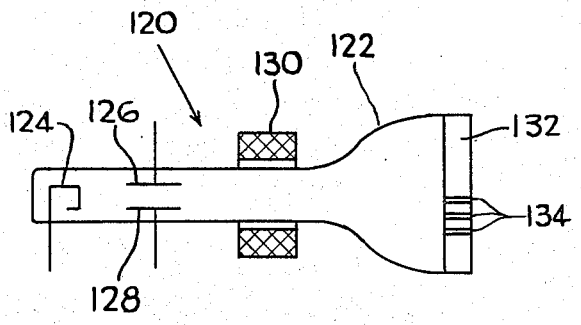
FIG. 9 is a schematic diagram illustrating a conventional cathode ray pin tube to which the method and apparatus of the present invention may be applied.

A conventional cathode ray pin tube 120 is shown in FIG. 9 and includes an evacuated envelope 122, a beam forming electrode 124, beam control electrodes 126,128 and deflection coil 130, the electrodes 124,126,128 and coil 130 being connected to appropriate circuitry in a known manner. The tube further includes a face plate 132 typically of dielectric material such as glass sealed to the forward end of envelope 122. A plurality of conductive pins 134 are embedded in face plate 132, each pin having one end externally exposed at the face of tube 120 and having a portion such as the opposite end face located for exposure to the tube electron beam. While only a few pins 134 are shown in FIG. 9 for convenience, typically a large number of such pins are located in face plate 132, closely-spaced and arranged in an array.

The quality of electrostatic print that is obtained from apparatus using cathode ray pin tubes heretofore available is seriously inhibited by problems relating to irregular charge distribution on the pin tube array and exponential swings in the voltage on the individual pins. The voltage swings of the individual pins must be controlled because too low a voltage swing will result in insufficient charge deposition on the surface of the dielectric medium to which the image is transferred from the tube during printing, and too large a voltage swing will result in serious degradation in the resolution capability of the process due to arcing or uncontrolled ionization. The individual pins making up the conductive array receive electrons, both directly from the electron beam and also from secondary sources, such as the glass face plate which serves as a backstop for the pins. The electrons incident on the glass face plate appear to affect significantly the quality of the electrostatic print ultimately obtained. In particular, the surface of the glass immediately under the conductive pin array may conceivably charge up to several thousand volts as a result of being bombarded by electrons from the beam which have traveled through to glass between the conductive pins. The resulting high electric field disturbance in the region of the pins causes pin voltage anomalies which affect the ultimate printing quality.

In accordance with the present invention, a single controlling electrode is located in proximity to the array of conductive pins in the tube face plate such that each pin and a corresponding portion of the controlling electrode are subjected to common electron bombardment as the pins are scanned successively by the electron beam. A control voltage is applied to the controlling electrode and is set at a desired value which is more negative than the potential of an unscanned pin. As a result, the maximum negative voltage of the pins is controlled to improve the ultimate quality of electrostatic printing provided by the tube.

Figure 10:
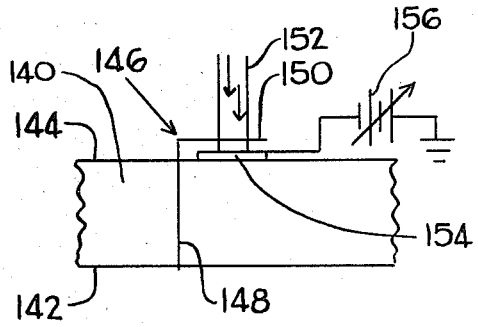
FIG. 10 is a schematic diagram illustrating the principles of the present invention for controlling pin voltage in a cathode ray pin tube.

The foregoing is illustrated in FIG. 10 which shows a portion of a glass face plate 140 of a cathode ray pin tube which plate has outer and inner surfaces 142 and 144, respectively, and a single conductive pin 146 in face plate 140. Pin 146 is of course representative of the large number of pins in the face plate of a tube. Pin 146 has a first portion 148 embedded in plate such that the end face thereof is exposed adjacent outer surface 142. Pin 146 has a second portion 150 extending from inner surface 144 and disposed at an angle to the direction of travel of the tube electron beam 152 which successively scans the pins. In the arrangement shown, pin portion 150 is at substantially a right angle to the direction of beam 152 but other angles can be employed. The angular orientation of pin portion 150 to beam 152 enables the accuracy of positioning the electron beam to be made less critical since instead of the relatively small area end faces of the pins being exposed to the beam, the angularly disposed portion 150 exposes a significantly increased target area for the beam.

A controlling electrode 154 in the form of a thin metal plate or ribbon is suitably held in place on face plate 140 in physical proximity to pin 146, in particular spaced closely behind pin portion 150 relative to the direction of travel of beam 152. Controlling electrode 154 is so located relative to pin portion 150 that as beam 152 scans pin portion 150 it substantially simultaneously scans a corresponding portion of controlling electrode 154. As a result, pin portion 150 and the corresponding portion of controlling electrode 154 are subjected to common electron bombardment. This occurs with each pin and corresponding portion of electrode 154 as beam 152 successively scans the array of pins. A source of control voltage 156 is connected to electrode 154, and the direct voltage of source 156 is set at a desired value which is more negative than the potential of an unscanned pin. In the foregoing arrangement, with electrode 154 being located rearwardly of pin portion 150 relative to direction of travel of beam 152, the controlling electrode may be viewed as a backing electrode, and the entire combination may be viewed as replacement of the glass backstop for the pin portions with a conductive backstop which is voltage controlled.

Figure 11:
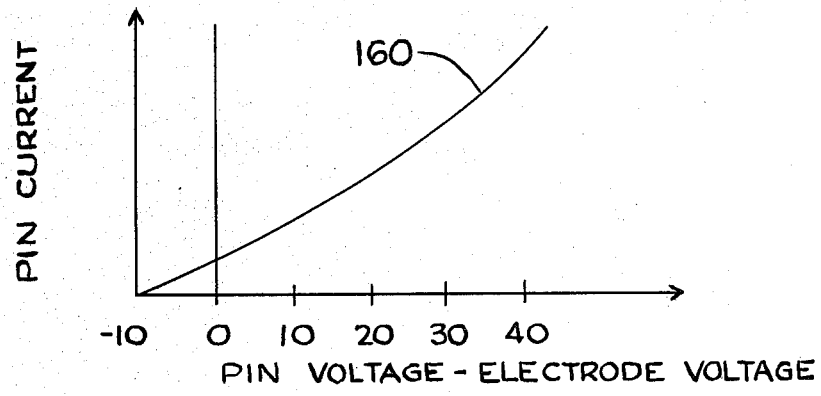
FIG. 11 is a graph showing the relationship between pin acceptance current and backing electrode to pin voltage in a cathode ray pin tube wherein the pin voltage is controlled according to the present invention.

As the electron beam 152 scans the array of pins in the face plate, in the region of the pins 146 and controlling electrode 154 primary electrons are present along with secondary electrons emitted by the pins 146 and dielectric face plate 140. The pins 146 accept electrons and thus are driven to a negative potential. With the controlling electrode 154 being connected to a desired potential which is more negative than the potential of an unscanned pin, an exchange of electrons takes place between the scanned pins and controlling electrode similar to the electron exchange described in connection with FIGS. 1–8. As the pin potential approaches the potential of the controlling electrode, the percentage of beam current accepted by the pin decreases and approaches zero corresponding to a potential that is slightly negative of the controlling electrode potential. This is illustrated in the graph of FIG. 11 wherein curve 160 represents pin acceptance current as a function of the voltage difference between controlling electrode 154 and the pins 146. This current-voltage relationship is similar to that relationship illustrated in FIG. 7. If some net electron current is extracted from the pins, that is equal to or greater than the pin acceptance current, the pin voltage stabilizes at a voltage near that of the controlling electrode 154. As a result the pin voltage is controlled by a single electrode potential, i.e. the voltage on controlling electrode 154, and in a manner which does not require connection of any leads to the pins for effecting the control. With the pin voltage being controlled, in particular the maximum negative voltage of the individual pins being controlled, the ultimate quality of electrostatic printing provided by the cathode ray pin tube is significantly improved.

Figure 12:
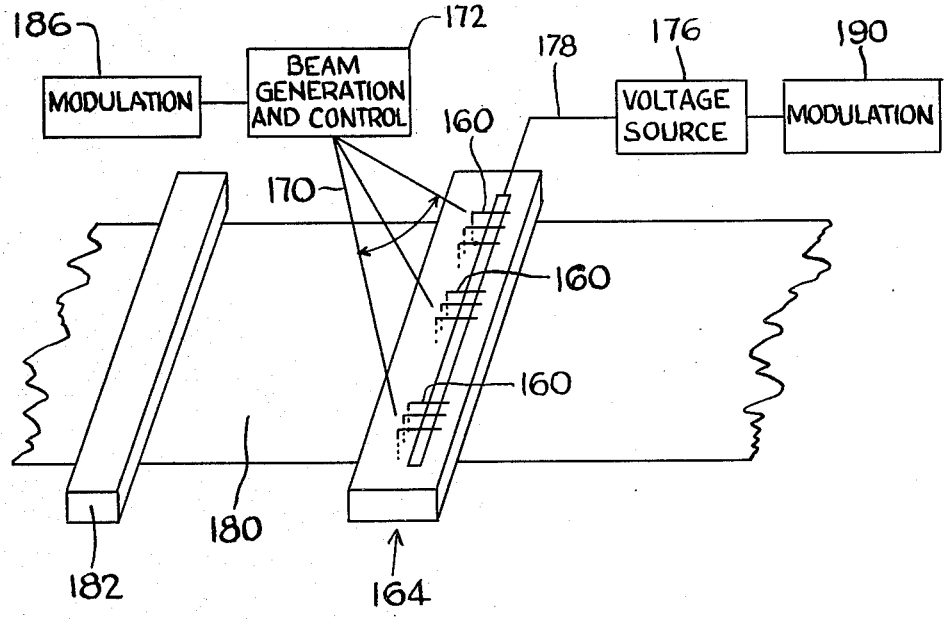
FIG. 12 is a schematic diagram of an electrostatic printing system including a cathode ray pin tube wherein the pin voltage is controlled according to the present invention.

FIG. 12 shows an image generation system including a cathode ray pin tube wherein the pin voltage is controlled according to the present invention. The system of FIG. 12 would find use, for example, in an electrostatic printer. A dielectric tube face plate generally designated 164 includes a one dimensional array of closely spaced conductive pins 166 along the length thereof. Only a few pins 166 are shown for convenience in illustration. A controlling or backing electrode 168 is supported by face plate 164 in proximity to the pin 166 as previously described. A preferred face plate construction will be shown and described in detail presently. A scanning electron beam 170 is generated and controlled by apparatus generally designated 172 in a known manner. Apparatus 172 includes beam forming and control electrodes and deflection coil as indicated in connection with FIG. 9. Face plate 164 and apparatus 172 are associated with a tube envelope (not shown) in a known manner. A source of control voltage 176 is connected by conductor 178 to controlling electrode 168. A dielectric belt 180 is moved by suitable drive means (not shown) past and in close proximity to the outer surface of face plate 164 so as to be exposed to the outer end surfaces of pins 166. A corona pre-charging unit 182 is located forwardly of the cathode ray pin tube with respect to the direction of movement of belt 180.

In operation, belt 180 is precharged by unit 182 and passed over the array conductive pins or electrodes 166 of face plate 164. The backing electrode 168 is controlled to limit the pin voltage excursion between a small negative excursion and some desired negative extreme. The desired voltage pattern on the array of pins 166 can be provided by modulating means 186 operatively connected to beam generating and controlling apparatus 172 for modulating the scanning beam amplitude with an information-containing signal. Alternatively, the desired pin voltage pattern can be provided by modulating means 190 operatively connected to voltage source 176 for modulating the voltage on backing electrode 166 with an information-containing signal. If desired, a combination of both modulation schemes can be employed. After receiving the charge image, the dielectric belt is passed through a conventional electrostatic toner bath or developer (not shown) where the charge pattern selectively picks up toner particles to convert the latent image to a visual image which then may be transferred to paper or used directly.

Figure 13:
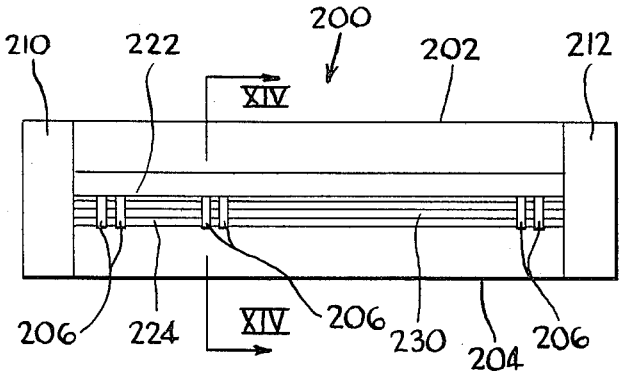
FIG. 13 is an elevational view of a face plate according to the present invention for use in a cathode ray pin tube.
Figure 14:
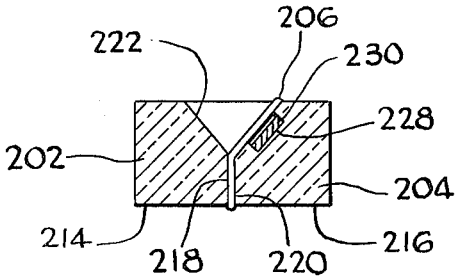
FIG. 14 is a sectional view taken about on line 14—14 in FIG. 13.
Figure 15:
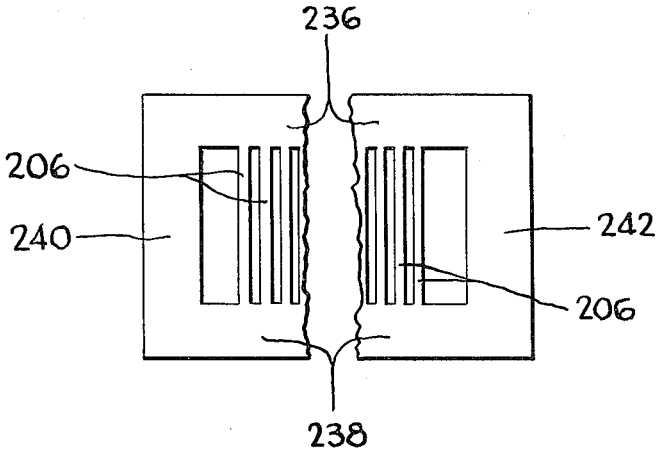
FIG. 15 is a fragmentary elevational view of an electrode array used in making the face plate of FIGS. 13 and 14.

FIGS. 13–15 illustrate a cathode ray pin tube face plate and method of making the same according to the present invention. The face plate 200 comprises two elongated segments 202 and 204 of dielectric material such as glass in side-by-side relation for receiving an array of conductive pins 206 therebetween. While only a few pins 206 are shown for convenience in illustration, a large number of closely-spaced pins are provided in face plate 200 along the length thereof between the end caps designated 210,212 in FIG. 13. Segments 202 and 204 have outer surfaces 214,216 respectively, which face in a direction exteriorly of the cathode ray pin tube in which face plate 200 is employed. In the face plate shown, surfaces 214,216 are planar, in substantially flush relation, and the common plane of surfaces 214,216 is substantially perpendicular to the longitudinal axis of the tube in which the face plate is installed.

Segments 202 and 204 each have first side surface portions 218 and 220, respectively, extending inwardly from the corresponding outer surfaces 214 and 216, i.e. toward the interior of the tube. In the face plate shown, the surface portions 218 and 220 are disposed substantially at right angles to the outer surfaces 214 and 216, respectively. The side surface portions 218 and 220 are in opposite facing relation as shown in FIG. 14 and are in contact with a portion of each of the pins 206 for holding the pins in a manner which will be described. Segments 202 and 204 each have second side surface portions 222 and 224, respectively, extending inwardly from the corresponding first side surface portion for facing in a direction into the tube. The surface portions 222,224 are disposed relative to the surface portions 218,220 and relative to each other in a manner defining a region facing the electron beam of the tube. At least one of the second surface portions, i.e. portion 224, is disposed at an angle to the direction of the electron beam and is in contact with another portion of each of the pins 206 for disposing the pin portions at an angle to the electron beam. In the face plate shown, both surface portions 218,220 are angularly disposed to define a V-shaped recess or groove extending along the entire length of face plate 200 between end caps 210,212. The apex of the V is at the junction between the second portions 222,224 and the first portions 218,220.

By virtue of the V-shaped groove defined by side surface portions 222,224 the array of pins 206 is bent at approximately a 45 degree angle to the direction of the electron beam. This same angle of approximately 45 degrees also is defined between surface portion 224 and end surface 216 of segment 204. This arrangement enables the accuracy of positioning of the tube electron to be made less critical since instead of requiring the beam to hit the relatively small axial end face of each pin 206, the bent over pin portions expose a significantly increases target area for the electron beam. While an angle of approximately 45 degrees is employed in the face plate shown, other angles can be utilized to accomplish the same result.

An elongated recess or groove 228 is provided in surface portion 224 which contacts the angularly disposed pin portions. Recess 228 extends substantially parallel to the longitudinal axis of face-plate segment 204 and substantially parallel to the array of pins 206. An elongated controlling or backing electrode 230 is in recess 228 and in spaced relation to the portions of pins 206 which lie along surface 224. Electrode 230 is a thin aluminum element such as would be obtained by taking aluminum wire and rolling it flat. The placement of electrode 230 in recess 228 establishes the appropriate spacing of electrode 230 from pins 206, that spacing being in the range from about 5 mils to about 20 mils in an illustrative face plate. The backing electrode 230 is held in place on segment 204 by frit which, as known by those skilled in the art, is a glass which has a high lead or lead oxide content which permits it to melt at a lower temperature and at the same time give expansion characteristics more nearly like that of the metal electrodes. The spacing between electrode 230 and pins 206 is basically determined by the depth of the groove 228 and the thickness of electrode 230 because each pin 206 extends from the center groove between surface portions 218 and 220 of segments 202 and 204, respectively, and rests at its upper end on the surface 224 in which groove 228 is formed. Electrode 230 is adapted to be connected to a source of control voltage for controlling the voltage on pins 206 when scanned by the tube electron beam as previously described. The voltage applied to electrode 230 should be more negative than that of an unscanned pin as previously described, and in an illustrative device electrode 230 will have a negative potential of about 500 volts.

In one method of making face plates 200, the array of pins 206 is provided initially in a ladder configuration as shown in FIG. 15. A single sheet of nickel stock is electro formed to provide a central section of the discrete wires or pins 206 attached at opposite ends to two parallel strips 236,238. In an actual sheet the central section containing pins 206 has a length equal to the desired length of the array, but two fragments of the sheet are shown in FIG. 15 for convenience, the fragments being relatively small in length but enlarged in width. The strips 236, 238 are joined by end sections 240,242. In an illustrative device, the ladder configuration is electro formed from a low sulphur, low stress nickel such as Watts nickel wherein each of the pins 206 has a length of about 0.400 inch, a width of about 0.0015 inch and a thickness of about 0.0001 inch, with the spacing between pins in the array being 0.0015 inch and with the overall length of the array of pin 206 being 8.25 inches.

In forming the face plate of FIGS. 12 and 14, the ladder configuration of FIG. 15 is shaped such as by bending or the like along the length thereof in the region of pins 206 such that the pins 206 have two angularly disposed length portions as shown in FIG. 14. In connection with such shaping, the portions of pins 206 which ultimately will lie along surface 224 are preloaded for a purpose to be described. The ladder configuration then is placed between face plate segments 202,204 and the segments are moved together and against the array such that the first side surface portions 218,220 are in opposite facing relation and in contact with a portion of each of the pins 206 as shown in FIG. 14, the preloaded portions of pins 206 are urged resiliently against side surface portion 224 of segment 204, the strip 238 of the ladder configuration projects outwardly beyond surfaces 214,216, and the strip 236 projects outwardly beyond the outer edge of surface portion 224. The two segments 202,204 are joined together by introducing frit material in the space between surface portions 218,220 containing portions of pins 206. Then strip 236 of the ladder configuration is removed such as by laser cutting and strip 238 is ground off or otherwise removed. The two end caps 210,212 which serve to close the ends of the V-shaped groove between segments 202,204 are held in place by frit material. The resulting face plate structure then is appropriately secured and sealed to a conventional cathode ray tube envelope.

By way of further example, in an illustrative face plate as described herein, glass such as Corning 012 or 008 has been found to be satisfactory for segments 202,204 and end caps 210,212. Each segment 202,204 has a length of about 8.32 inches, a width of about 0.32 inch, and a height of about 0.205 inch. The first side surface portions 218,220 each has a width of about 0.073 inch measured in a direction perpendicular to the corresponding outer surface 214,216. Both surface portions 222 and 224 define angles of about 45 degrees with surfaces 214 and 216, respectively. Groove 228 has a width of about 0.128 inch and a depth of about 0.011 inch. The overall length of a face plate structure including end caps 210,212 as shown in FIG. 13 is about 8.80 inches, the overall width is about 0.72 inch, and the overall height is about 0.20 inch.

It is therefore apparent that the present invention accomplishes its intended objects. While several embodiments of the present invention have described in detail, this is for the purpose of illustration, not limitation.

I claim:

1. A method of controlling the voltage on an electrode in an electronic tube device of the electron beam type comprising the steps of:

(a) providing a controlling electrode in physical proximity to the electrode to be controlled and positioning said controlling electrode so that said controlled and controlling electrodes are scanned substantially simultaneously by the tube electron beam;

(b) applying a control voltage of predetermined magnitude and polarity to said controlling electrode;

(c) scanning said controlled and controlling electrodes substantially simultaneously to provide primary and secondary electrons in the region of said electrodes; and (d) the magnitudes and polarity of the control voltage being selected to cause an exchange of electrons between said controlled and controlling electrodes during the period of electron bombardment causing the voltage on said controlled electrode to switch to a desired value.

2. A method according to claim 1, wherein said controlling electrode is placed between two controlled electrodes in a substantially coplanar relation and further including the step of controlling the width of the scanning electron beam so that the scanned beam area of the controlling electrode and one of the controlled electrodes is small with respect to the distance from the scanned area to the other of the controlled electrodes.

3. A method according to claim 1, where said step of scanning is performed at an accelerating potential selected to provide a ratio of secondary electrons to primary electrons greater than one in the region of the electrodes.

4. A method according to claim 1, where the voltage difference between controlling and controlled electrodes is selected at a value between the maximum and minimum accelerating voltages providing a secondary emission ratio greater than one.

5. A method according to claim 1, further including supplying bias current to said electrodes to remove electrons therefrom.

6. In an electronic tube device of the electron beam type having an electrode to be controlled located in said tube for bombardment by an electron beam, the improvement comprising:

(a) a controlling electrode located in said tube in proximity to said controlled electrode and for common electron bombardment with said controlled electrode by said beam; and (b) means for applying a control voltage to said controlling electrode whereby when said electrodes are scanned by the electron beam substantially simultaneously to provide primary and secondary electrons in the region of said electrodes an exchange of electrons takes place between said electrodes and the voltage on said controlled electrode switches to a voltage at or near the voltage on said controlling electrode.

7. Apparatus according to claim 6, further including a plurality of electrodes to be controlled, said controlling electrode being located in proximity to each of said controlled electrodes for common electron bombardment with each of said controlled electrodes by said beam.

8. Apparatus according to claim 6, wherein said controlled electrode and said controlling electrode are located in closely spaced and substantially coplanar relation in said device.

9. Apparatus according to claim 8, further including another controlled electrode in closely-spaced relation to said controlling electrode and substantially coplanar therewith so that said controlling electrode is between said controlled electrodes, and means for controlling the width of said electron beam so that the scanned beam area of said controlling electrode and one of said controlled electrodes is small with respect to the distance from the scanned area to the other of said controlled electrodes.

10. Apparatus according to claim 7 wherein said controlled electrodes are located in spaced relation in one plane and said controlling electrode is located in another plane substantially parallel to said one plane, said controlling electrode being located downstream from said controlled electrodes with respect to the direction of travel of electron in said beam.

11. Apparatus according to claim 6, further including means for providing an accelerating potential for said beam of a magnitude providing a ratio of secondary electrons to primary electrons in the region of said electrodes greater than one.

12. Apparatus according to claim 6, further including means for controlling the voltage difference between said controlling and controlled electrodes to a value between the maximum and minimum accelerating voltages providing a secondary emission ratio greater than one in the region of said electrodes.

13. Apparatus according to claim 6, further including means for supplying bias current to said electrodes to remove electrons therefrom.

14. A method of controlling the voltage on the conductive pins of a cathode ray pin tube including an array of said pins extending along a faceplate of said tube and selectively scanned by an electron beam comprising the steps of:

(a) providing a controlling electrode in physical proximity to said conductive pins for common electron bombardment with said pins by the electron beam of said tube; and (b) applying a control voltage to said controlling electrode having a magnitude and polarity selected such that in response to electron bombardment of said pins and said controlling electrode the potential on said pins stabilizes at a potential near that of said electrode.

15. A method according to claim 14, wherein said control voltage has a polarity which is relatively more negative than the polarity of said conductive pins when not scanned by the beam.

16. A method according to claim 14, wherein the percentage of electron beam current accepted by said conductive pins decreases and approaches zero corresponding to a voltage which is slightly negative with respect to said control voltage.

17. A method according to claim 14, wherein a quantity of net electron current is extracted from said conductive pins which is equal to or greater than the electron beam current accepted by said pins.

18. A method according to claim 14, further including modulating the amplitude of the scanning electron beam with a signal containing information to be transferred by said tube.

19. A method according to claim 14, further including modulating said control voltage with a signal containing information to be transferred by said tube.

20. In a cathode ray pin tube comprising an array of conductive pins extending along a faceplate of said tube for selective scanning by an electron beam, means for controlling the voltage on said pins comprising:

(a) a controlling electrode;

(b) means for positioning said controlling electrode in physical proximity to said pins for common electron bombardment with said pins by said electron beam; and (c) means for applying a control voltage to said controlling electrode having a magnitude and polarity selected such that in response to electron bombardment of said pins and said electrode the potential on said pins stabilizes at a potential near that of said electrode.

21. Apparatus according to claim 20, wherein each of said pins has an outer end portion substantially perpendicular to the plane of said tube faceplate and substantially parallel to the direction of said beam and an inner portion facing said beam and disposed at an angle to the direction of said beam, and wherein said positioning means locates said controlling electrode between said inner and outer end portions of said pins.

22. Apparatus according to claim 20, wherein said controlling electrode is elongated and extends along said face plate generally parallel to the longitudinal axis of said face plate and for a length sufficient to be in proximity to all of said pins.

23. Apparatus according to claim 20, wherein said voltage applying means comprises an adjustable d.c. voltage source having positive and negative terminals and means for connecting the negative terminal of said source to said controlling electrode.

24. Apparatus according to claim 20, further including means for modulating the amplitude of said electron beam with a signal containing information to be transferred by said tube.

25. Apparatus according to claim 20, further including means operatively connected to said voltage applying means for modulating said control voltage with a signal containin information to be transferred by said tube.

* * * * *